US006920993B2

(12) United States Patent
Sheng-Bin

(10) Patent No.: US 6,920,993 B2
(45) Date of Patent: Jul. 26, 2005

(54) SOFT STORAGE CONTAINER WITH ZIP-FASTENED BOTTOM

(75) Inventor: Hsieh Sheng-Bin, GuangDong (CN)

(73) Assignee: Sourcing Solutions, Inc., Hudson, WI (US)

( * ) Notice: Subject to any disclaimer, the term of this patent is extended or adjusted under 35 U.S.C. 154(b) by 0 days.

(21) Appl. No.: 10/633,898

(22) Filed: Aug. 4, 2003

(65) Prior Publication Data

US 2005/0029261 A1 Feb. 10, 2005

(51) Int. Cl.[7] ..... B65D 8/14
(52) U.S. Cl. ..... 220/6; 220/4.28
(58) Field of Search ..... 220/6, 4.28, 9.4, 220/0.6; 229/117; 190/107; 383/4, 97, 119

(56) References Cited

U.S. PATENT DOCUMENTS

| | | | | | |
|---|---|---|---|---|---|
| 2,163,669 | A | * | 6/1939 | Didden | 72/98 |
| 3,073,367 | A | * | 1/1963 | Samara | 383/97 |
| 3,708,045 | A | * | 1/1973 | Katz | 190/115 |
| 4,630,746 | A | | 12/1986 | Fortenberry | |
| 4,716,947 | A | * | 1/1988 | Haddock | 150/106 |
| 4,951,818 | A | * | 8/1990 | Johnson | 206/335 |
| 5,285,656 | A | | 2/1994 | Peters | |
| 5,492,269 | A | | 2/1996 | Sung | |
| 5,996,882 | A | | 12/1999 | Randall | |
| 6,102,569 | A | | 8/2000 | Wang | |
| 6,116,045 | A | | 9/2000 | Hodosh et al. | |
| 6,149,025 | A | | 11/2000 | Wang | |
| 6,238,091 | B1 | | 5/2001 | Mogil | |
| 6,244,399 | B1 | * | 6/2001 | Birkestrand | 190/103 |
| 6,276,582 | B1 | | 8/2001 | Alexander | |
| 6,409,076 | B1 | | 6/2002 | Wang | |
| 6,588,590 | B1 | | 7/2003 | Wang | |

* cited by examiner

*Primary Examiner*—Joseph C. Merek
(74) *Attorney, Agent, or Firm*—Jansson, Shupe & Munger, Ltd.

(57) ABSTRACT

An erectable/collapsible soft storage container having a body of flexible material that includes two first sidewalls, two second sidewalls and a bottom. At least three sidewalls are embedded with a hard board. The bottom has two bottom flaps and an edge-fastener engaging one bottom flap to the other. The container is held erect when the bottom flaps are attached and disengaging the flaps allows the container to collapse. Preferably the sidewalls are orthogonal to the bottom and form a rectangular top edge parallel to the bottom. The edge-fastener can be a zip fastener.

19 Claims, 2 Drawing Sheets

SOFT STORAGE CONTAINER WITH ZIP-FASTENED BOTTOM

FIELD OF THE INVENTION

This invention is related generally to storage containers and, more particularly, to erectable/collapsible storage containers having a body of flexible material.

BACKGROUND OF THE INVENTION

Certain soft storage containers are known in the prior art. Soft storage containers are containers having a body made from a flexible material such as canvas or leather. Many of them, however, are not collapsible. While in some instances these containers may have been disassembled for shipping, once assembled they cannot be collapsed or disassembled again without great difficulty and often times permanent damage to the container. Those containers that can be collapsed have complicated structures making it difficult to do so. They require a certain degree of manual dexterity on the part of individuals attempting to fold or flatten them. Others are costly to manufacture or are collapsible only after the container's framework has been disassembled into multiple individual parts.

Soft storage containers of simple structure that can be collapsed and later erected into its original shape without extensive assembly would provide great benefits to consumers. Their light weight would enable them to be easily carried with their contents to whatever location is desired. When empty, these containers could be collapsed so as not to take up unnecessary space.

In particular, such containers, unlike other collapsible bins, would feature rigid sides. Rigid sides would enable the containers to be more durable and thereby have a longer useful life. Rigid sides would also enable the container to be self-supporting when erected and would ensure that the container maintains the same structure regardless of the number of times it has been collapsed and later re-erected.

OBJECTS OF THE INVENTION

It is a primary object of this invention to provide a erectable/collapsible soft storage container that overcomes some of the problems and shortcomings of the prior art, including those mentioned above.

Another object of this invention is to provide a soft storage container that can be collapsed and later erected into its original shape.

Another object of this invention is to provide a novel soft storage container that has an integral fabric body and is collapsible along diagonal vertical edges.

Another object of the invention is to provide an exceptional soft storage container that is simple in structure, easy to collapse, and inexpensive to manufacture.

Another object of the invention is to provide an improved erectable/collapsible soft storage container that is light in weight, self-supporting when erected, and durable.

SUMMARY OF THE INVENTION

A novel soft storage container is provided in accordance with this invention that can be collapsed and later erected into its original shape. The container comprises a body of flexible material having two first sidewalls, two second sidewalls, and a bottom. At least three sidewalls are embedded with a hard board. The bottom of the container has two bottom flaps and an edge-fastener.

Each bottom flap on this container has a first bottom-flap edge, a second bottom-flap edge, and a diagonal-edge. Each first bottom-flap edge is attached to a different first sidewall and each second bottom-flap edge is likewise attached to a different second sidewall. The bottom flaps have dimensions wherein the diagonal-edge is longer than either bottom-flap edge. The edge-fastener is provided to engage each diagonal-edge to the other. When the edge-fastener is engaged, the container is self-supporting and erected. Disengaging the edge-fastener, on the other hand, enables the container to be collapsed into a substantially flat configuration. It is highly desirable that the edge-fastener be a zip fastener.

In certain preferred embodiments, each sidewall is orthogonal or perpendicular to the bottom. It is most preferred that the first sidewalls be substantially congruent or identical to each other. In these embodiments, the second sidewalls are also substantially identical to each other. It may be desirable in certain cases to have each sidewall embedded with a hard board.

In other highly preferred embodiments, the container has a body with two opposed first sidewalls and two opposed second sidewalls. It is often desirable that the first sidewalls be congruent in shape and size to each other and the second sidewalls likewise be identical in shape and size. Highly desirable is where the top edge of the body forms a rectangle that lies in a substantially horizontal plane. In certain cases, each sidewall is orthogonal to the bottom and the top edge forms a square.

In another most preferred embodiment, the container includes a hard bottom board. This bottom board is seated within the interior of the body of the container and supported by the bottom. Highly preferred is where the bottom board can be removed from the interior of the container.

Another desired form of this invention finds the container including a handle on at least one sidewall. In certain preferred cases, it is desirable that each sidewall be embedded with a hard board and that it form a hard-wall pocket with which to receive the hard board embedded there.

Highly desired embodiments have each sidewall attached to each adjacent sidewall and to the bottom flaps so that the container comprises an integral body of flexible material. The term "integral" as used herein refers to the state of completeness in the construction of the container from flexible material, i.e. a continuous piece of material with or without seams, such that no further assembly or addition is needed to form the container other than the attaching together of the bottom flaps by means of the edge-fastener.

DETAILED DESCRIPTION OF PREFERRED EMBODIMENTS

Figure 1:
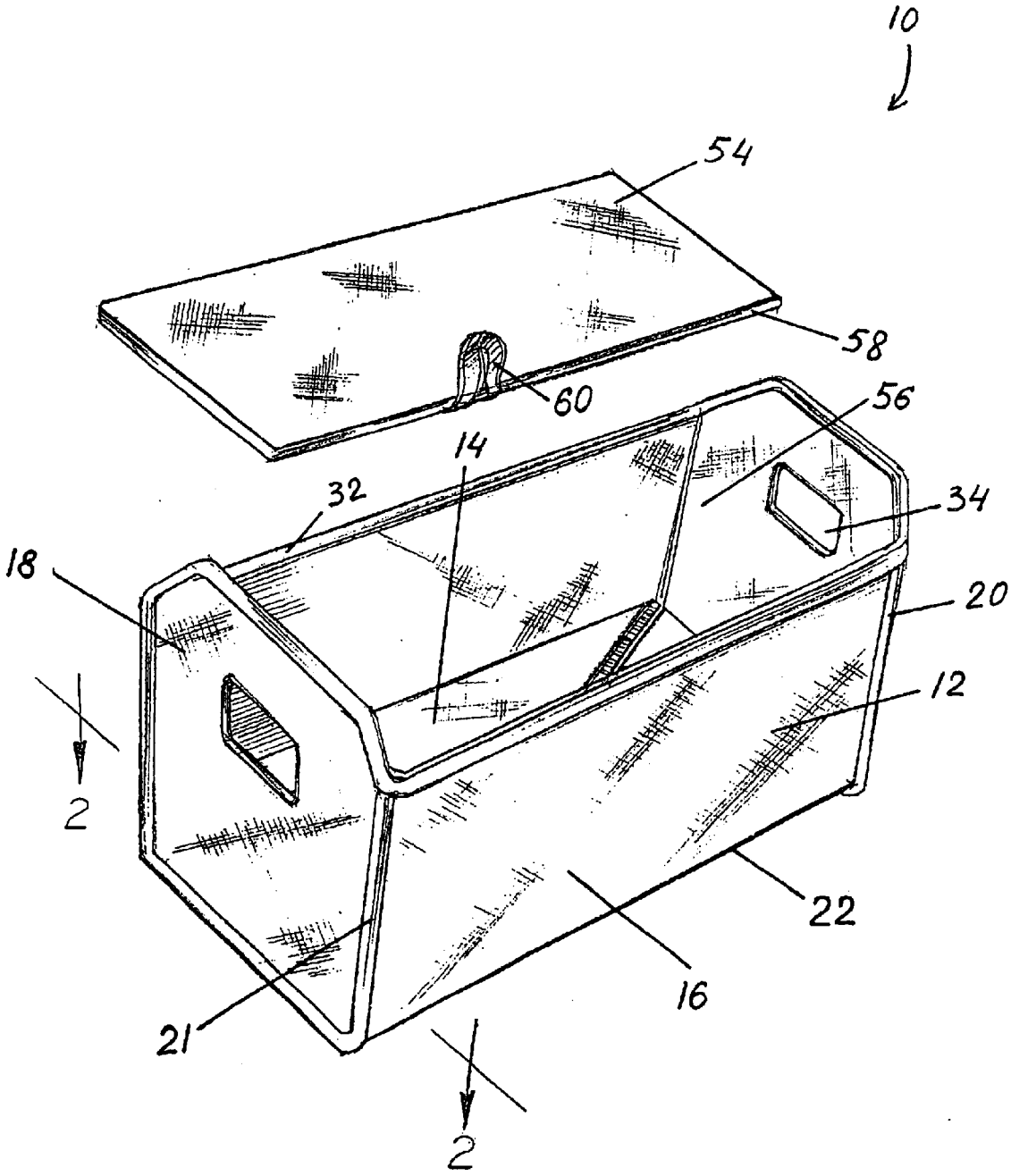
FIG. 1 is an exploded view of a soft storage container in accordance with this invention.

The drawings illustrate an exceptional soft storage container that can be easily erected and collapsed in accordance with this invention. As seen in FIG. 1, container 10 is comprised of a body 12 formed from flexible material. Such flexible materials range from woven fabrics such as canvas to such non-woven substances as leather, polypropylene, and polyvinyl chloride. Body 12 need not be formed from a single material but can, for example, have an outer wall of canvas and an inner wall of polypropylene for ease in cleaning. Other useful combinations will be apparent to those skilled in the art.

As illustrated in FIG. 1, body 12 has a bottom 14, two first sidewalls 16, and two second sidewalls 18. Each sidewall 16, 18 is permanently joined to the two adjacent sidewalls along both of its side edges 20, 21 to form a contiguous peripheral ring. Furthermore, each sidewall 16, 18 has a bottom sidewall edge 22 that is permanently attached to bottom 14. The union between sidewalls 16, 18 along side edges 20, 21 and between sidewalls 16, 18 and bottom 14 along bottom sidewall edges 22 establishes a body 12 that is integral. Attachment of sidewall 16 with sidewall 18 or of sidewall 16, 18 with bottom 14 is achieved either by using the same material for both portions or by joining two separate pieces of material together as with stitches or adhesive in a manner known to those skilled in the art.

Figure 2:
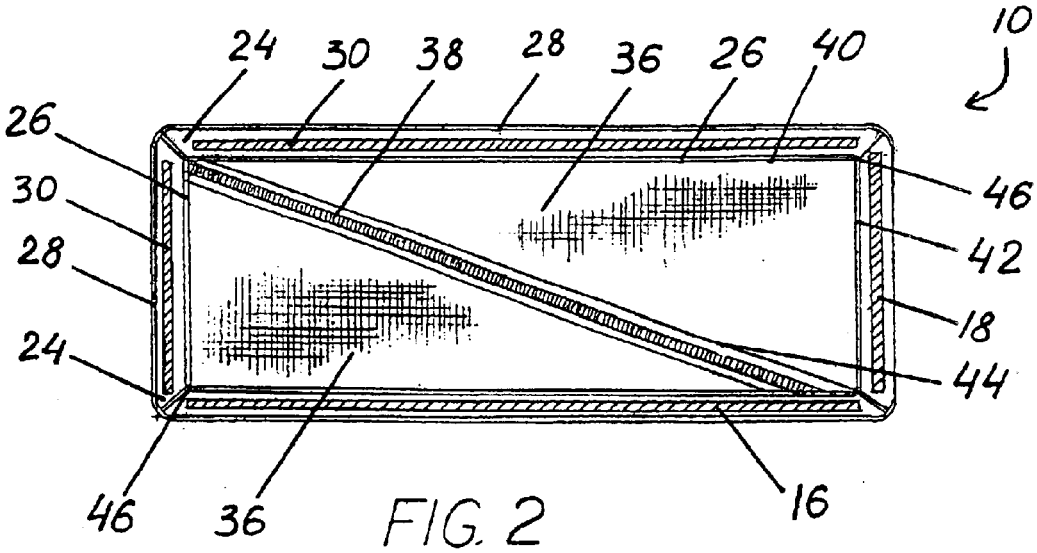
FIG. 2 is a top sectional view of the container along section line 2-2 in FIG. 1.

FIG. 2 reveals that each sidewall 16, 18 has a full-wall pocket 24. Pocket 24 is formed from inner-wall panel 26 and outer-wall panel 28 being joined at side edges 20, 21 and bottom sidewall edge 22. Pocket 24 is sized to receive a hard full-wall board 30. Each board 30 is preferably thin with a height and width slightly less than the corresponding dimensions of the receiving pocket 24. After a board 30 has been embedded within pocket 24 of each sidewall 16, 18, board 30 is secured within pocket 24 by joining inner-wall panel 26 to outer-wall panel 28 along top edge 32.

Figure 4:
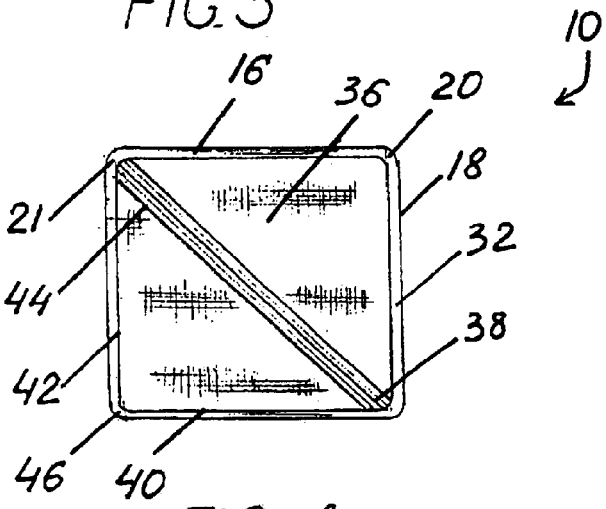
FIG. 4 is a top view of another preferred embodiment having a square top edge.

One sees from FIGS. 1, 2 and 4 that first sidewalls 16 are opposite each other within body 12 and congruent in shape and size. Second sidewalls 18 are likewise opposed to each other and identical in shape and size. When container 10 is erected, as illustrated in FIG. 1, the bottom sidewall edge 22 of each sidewall 16, 18 is perpendicular to the bottom edges 22 of each adjacent sidewall 16, 18. Moreover, first sidewalls 16 and second sidewalls 18 are substantially vertical, i.e. perpendicular or orthogonal to bottom 14.

Bottom 14 is formed from two bottom flaps 36 and a zip fastener 38. Each bottom flap 36 has a first bottom-flap edge 40, a second bottom-flap edge 42, and a diagonal-edge 44. As seen in FIGS. 2 and 4, each first bottom-flap edge 40 is attached to a different first sidewall 16. Likewise, each second bottom-flap edge 42 is joined to a different second sidewall 18. The first bottom-flap edge 40 and the second bottom-flap edge 42 of each bottom flap 36 meet at a fold point 46. Each fold point 46 is contiguous to second side edges 21.

Figure 3:
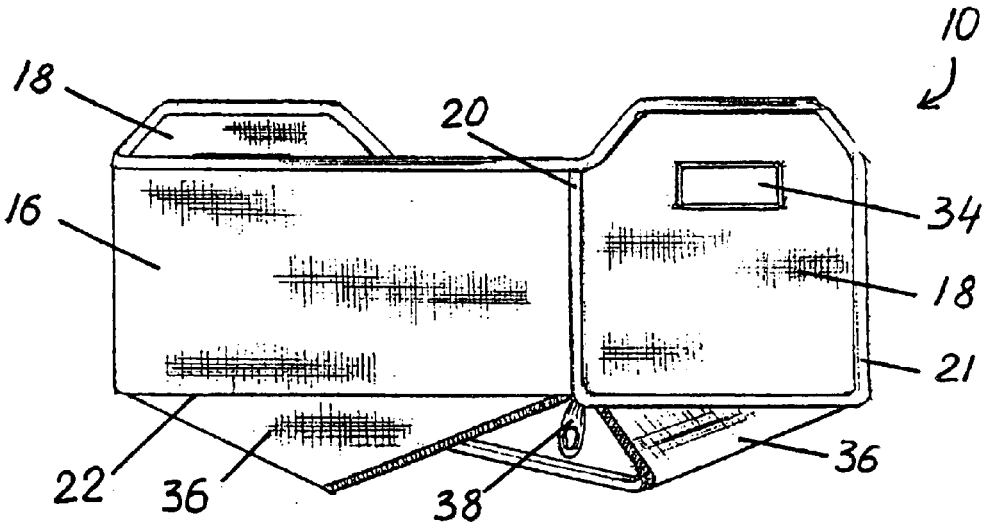
FIG. 3 is a side view of a collapsed container in accordance with this invention.

Each diagonal-edge 44 is longer than either first bottom-flap edge 40 or either second bottom-flap edge 42. Zip fastener 38 attaches diagonal-edges 44 to each other. Zip fastener 38 is preferably a zipper as shown in FIGS. 2 and 3 or hook and loop strips made of a material such as Velcro® brand fasteners. Engaging zip fastener 38 completes bottom 14 and allows container 10 to maintain an erect and open configuration. On the other hand, disengaging or unfastening zip fastener 38 collapses container 10 by allowing sidewalls 16, 18 to flatten outward along first side edges 20 while folding inward at second side edges 21. With collapse, container 10 can be given a substantially flat configuration.

Each board 30 provides reinforcement to sidewalls 16, 18. This reinforcement allows the flexible material of sidewalls 16, 18 to stand upright when container 10 is erected. Boards 30 also give sidewalls 16, 18 the rigidity needed to increase the durability and the useful life of container 10. Moreover, such rigidity insures that container 10 returns substantially to its original shape despite being repeatedly collapsed and then re-erected. Boards 30 are preferably made from cardboard but fiber board, particle board, plastic or thin sheet metal can be used.

As shown in FIGS. 1 and 3, container 10 is provided with a handle-aperture 34 on each second sidewall 18 to serve as a handle. A handle for use with container 10 can be provided in a number of other ways apparent to those skilled in the art, such as the attachment of a strap to two opposing sidewalls 16, 18.

As seen in FIG. 1, a hard bottom board 54 is placed within interior 56 to rest upon bottom 14. Bottom board 54 provides a rigid and reinforcing surface to strengthen bottom 14 of container 10. Bottom board 54 is preferably covered in the same material as that comprising body 12. Bottom board 54 is sized so as to allow its lateral edges 58 to frictionally contact inner-wall panels 26 of sidewalls 16, 18. Loop 60 is attached to bottom board 54 as an aid when inserting and removing bottom board 54 into and from body 12.

While the principles of the invention have been shown and described in connection with specific embodiments, it is to be understood that such embodiments are by way of example and are not limiting.

What is claimed is:

1. An erectable/collapsible soft storage container comprising a body of flexible material having:

two first sidewalls and two second sidewalls, each of the sidewalls having a top and bottom edge and each of at least three of the sidewalls being embedded with one hard board;

an open top defined by the top edges; and a bottom opposite the top having two bottom flaps and an edge-fastener, each flap having a first bottom-flap edge, a second bottom-flap edge, and a diagonal-edge, wherein each first bottom-flap edge is attached with respect to the bottom edge of a different first sidewall and each second bottom-flap edge is attached with respect to the bottom edge of a different second sidewall and the diagonal-edge is longer than any bottom-flap edge, the edge-fastener enabling engagement of one diagonal-edge to the other diagonal-edge, whereby engaging the diagonal-edges holds the container erect and disengaging the diagonal-edges allows the container to collapse.

2. The container of claim 1 wherein the edge-fastener is a zip fastener.

3. The container of claim 2 wherein each sidewall is orthogonal to the bottom.

4. The container of claim 3 wherein one first sidewall is substantially congruent to the other first sidewall and one second sidewall is substantially congruent to the other second sidewall.

5. The container of claim 4 wherein each sidewall is embedded with one hard board.

6. The container of claim 2 wherein the body has two opposed first sidewalls and two opposed second sidewalls.

7. The container of claim 6 wherein one first sidewall is substantially congruent to the other first sidewall and one second sidewall is substantially congruent to the other second sidewall.

8. The container of claim 7 wherein the body has a rectangular top edge in a substantially horizontal plane.

9. The container of claim 8 wherein each sidewall is orthogonal to the bottom.

10. The container of claim 9 wherein the top edge forms a square.

11. The container of claim 10 wherein each sidewall is embedded with one hard full-wall board.

12. The container of claim 1 further comprising a hard bottom board whereby the container when erected defines an interior and said bottom board is seated within the interior and is supported by the bottom.

13. The container of claim 12 wherein the bottom board is removable from the interior of the body.

14. The container of claim 1 further comprising a handle on at least one sidewall.

15. The container of claim 1 wherein each sidewall is embedded with one hard board.

16. The container of claim 15 wherein each sidewall forms hard-wall pocket to receive the bard board.

17. The container of claim 1 wherein each sidewall is bound to each adjacent sidewall and each sidewall is bound to one of the bottom flaps whereby the container has an integral body of flexible material.

18. The container of claim 16 wherein each board is a full-wall board.

19. The container of claim 1 wherein each board is a full-wall board.

* * * * *